United States Patent [19]

Cahn et al.

[11] 4,110,987

[45] Sep. 5, 1978

[54] THERMAL ENERGY STORAGE BY MEANS OF REVERSIBLE HEAT PUMPING UTILIZING INDUSTRIAL WASTE HEAT

[75] Inventors: Robert P. Cahn, Millburn; Edward W. Nicholson, Summit, both of N.J.

[73] Assignee: Exxon Research & Engineering Co., Linden, N.J.

[21] Appl. No.: 773,705

[22] Filed: Mar. 2, 1977

[51] Int. Cl.[2] ..... F01K 3/00

[52] U.S. Cl. ..... 60/652; 60/659

[58] Field of Search ..... 60/643, 645, 652, 659, 60/670, 698, 716; 290/2, 40, 52

[56] References Cited

U.S. PATENT DOCUMENTS

| | | | |
|---|---|---|---|
| 1,066,348 | 7/1913 | Voorhees | 60/649 |
| 3,631,673 | 1/1972 | Charrier | 290/52 X |
| 3,681,920 | 8/1972 | Margen | 60/652 |
| 3,842,605 | 10/1974 | Tegtmeyer | 60/678 |
| 3,886,749 | 6/1975 | Pacault | 60/659 X |
| 3,998,695 | 12/1976 | Cahn | 60/659 |
| 4,003,786 | 1/1977 | Cahn | 60/659 X |
| 4,043,130 | 8/1977 | Brown | 60/652 |

*Primary Examiner*—Allen M. Ostrager
*Attorney, Agent, or Firm*—Joseph J. Allocca

[57] ABSTRACT

An improved process for storing the off-peak electrical output of an electricity generating plant in the form of heat by using said off-peak electrical output to raise the temperature level of a quantity of stored low vapor pressure thermal energy retention material and recalling said stored heat during periods of peak power demand in the form of electrical power, or industrial process heat wherein the excess electrical power, running a compressor (i.e. heat pump), compresses low grade heat containing vapor thereby raising the temperature and said compressed high heat is transferred to a LVP thermal energy retention material, the improvement comprising using as a source of low grade heat the waste heat generated by industrial and/or municipal installation such as refineries, steel mills, incinerators, etc. The process utilizes hot low vapor pressure (LVP) thermal energy retention material and appropriate storage means and cold LVP thermal energy retention material and appropriate storage means, low level, low grade waste heat either alone or in combination with stored hot water, most preferably alone, heat exchanger means, heat pumping means, turbine means, electric motor means and generator means and/or industrial process heat utilization means.

8 Claims, 1 Drawing Figure

FIGURE I

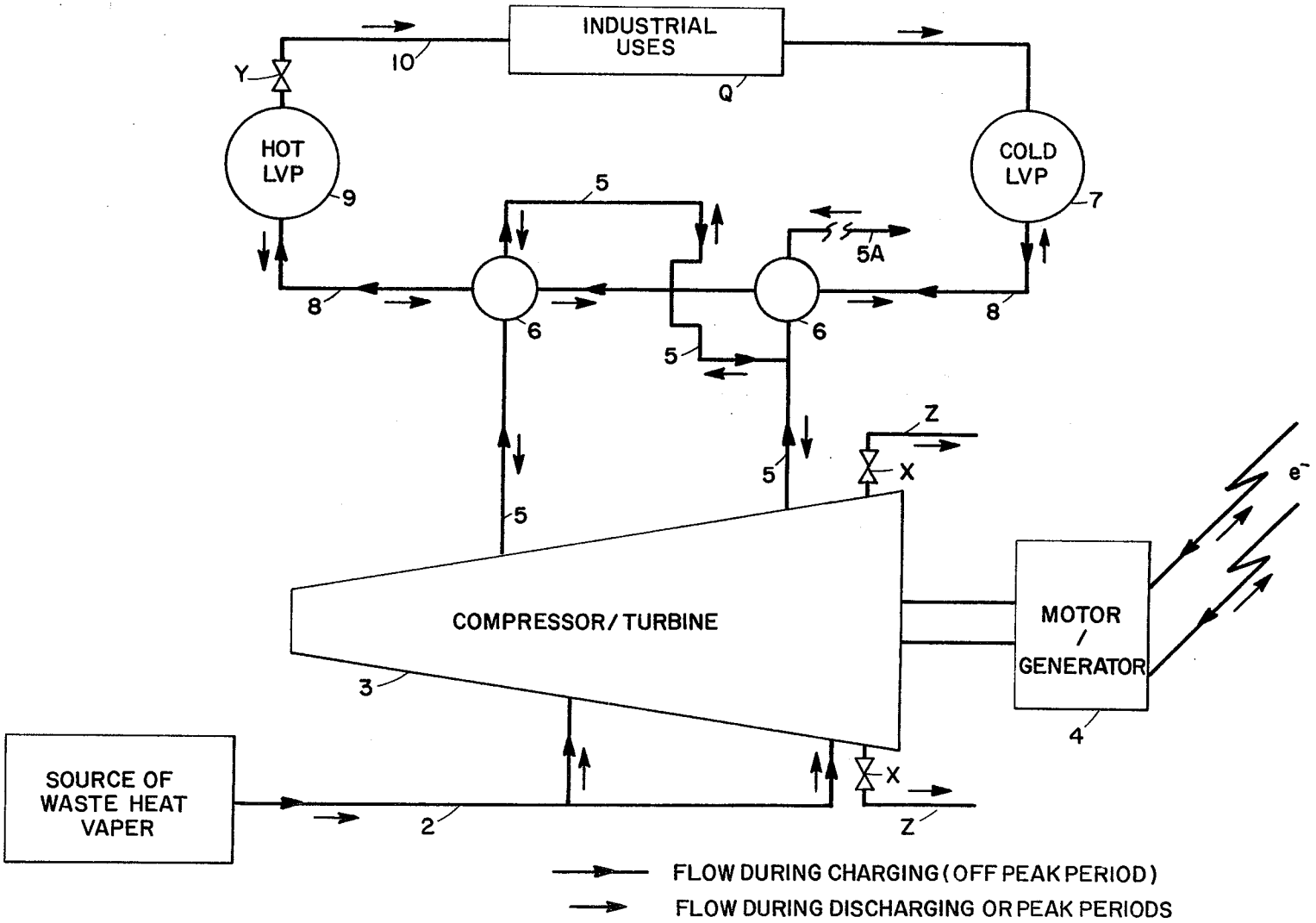
FIGURE I

THERMAL ENERGY STORAGE BY MEANS OF REVERSIBLE HEAT PUMPING UTILIZING INDUSTRIAL WASTE HEAT

DESCRIPTION OF THE INVENTION

An improved method is described for storing the off-peak electrical output of an electricity generating plant by raising the temperature level of a quantity of stored heat retention material and for recalling said stored heat when needed, i.e. during periods of peak power demand for the purpose of electrical power generation or to be utilized as high level industrial process heat. The process utilizes hot low vapor pressure (LVP) thermal energy retention material and appropriate storage means, and cold LVP thermal energy retention material and appropriate storage means, a source of low grade industrial and/or municipal waste heat either alone or in combination with stored hot water derived from such waste heat, heat exchanger means, heat pump means, turbines, electric motors, generators or, in the alternative or simultaneously, industrial process heat utilization means. The improvement described in the above recited process is the utilization of industrial and/or municipal waste heat, (i.e. low grade heat) as the heat utilized to generate the vapor which is compressed by a heat pump driven by the excess electrical power of the power grid to a higher temperature with heat transfer from this compressed vapor at high temperature to LVP material for storage, for use at a later time when demand for power (energy) is greater than the normal supply available from the normal heat sources (boilers) in the power grid. During low power demand periods, vapor produced by low level industrial and/or municipal waste heat is compressed, by means of excess electrical power in a compressor, to a high pressure and the heat contained in this compressed vapor at a high temperature is transferred through heat exchanger means to a LVP thermal energy retention material moving from cold storage means to hot storage means through the heat exchanger means. The hot LVP material is stored at 450°-600° F. at atmospheric pressure in isolation from the external atmosphere (i.e. under an inert gas blanket or floating roof). During high power demand periods, the energy stored in the LVP material is transferred to some energy transfer fluid (i.e. air, freon, methane, ethane, ammonia, etc., water, etc.) which fluid is used either to generate electricity by powering a turbine and generator or used to supply high level industrial process heat when and where needed. Alternately, the hot LVP material itself can be used directly as the industrial process heating fluid, or can be used hot as feed to a high temperature process such as hydrocarbon cracking. By the use of the normally discarded waste heat available from municipal and/or industrial operations a very efficient system is afforded wherein, depending on the temperature of the waste heat available a system possessing an energy storage efficiency (expressed as power recovered divided by power put into the storage system) of from 76 to over 136% (when the waste heat temperature level ranges from 125° F. to 210° F.) can be achieved.

The improvement is particularly well suited to the recovery of useful energy from waste heat which is normally discarded to the environment, i.e. the air or water. Methods of producing useful energy from such waste heat sources have been proposed and installed in some cases, but are usually not technically or economically practical because of the low thermal efficiency which can be achieved with such systems. It has now been found, surprisingly, that by coupling such low level heat sources with the storage of high level energy produced in off-peak periods, excellent overall efficiencies are realized with the result that some previously discarded waste heat is now effectively converted into useful energy. This can be seen from data presented later which show that by using waste heat, the efficiency (power out/power in) of a heat-pump storage system can be raised from 57% without waste heat being available to over 136% when 210° F. waste heat is fed into the system. The increased efficiency (increased power out/unit of power fed into the system) can only be the result of net power produced from the waste heat fed into the system. Therefore, the invention is not only a way to store effectively and efficiently off-peak power by means of thermal energy, but also a way to recover, as useful thermal or electrical energy, waste heat which has up to now been discarded. It, therefore, reduces the overall primary energy requirements, since energy produced from waste heat replaces energy which heretofore had to be produced from primary energy sources.

DESCRIPTION OF THE FIGURE

FIG. 1 shows a stylized schematic of the instant invention.

The use of industrial and/or municipal waste heat in energy storage has the advantage of markedly improving the overall efficiency of the heat pump energy storage process described in Ser. No. 738,604 herein incorporated by reference. The process of Ser. No. 738,604 details a heat pump energy storage system wherein stored hot water is flashed to produce steam which steam is compressed by the heat pump running off of excess electricity from the power grid. Steam is fed from the various compression stages to heat exchangers wherein the thermal energy of the compressed steam is transferred by condensation to the LVP material moving from cold storage means to hot storage means through the heat exchanger means. Normally, hot water stored at atmospheric pressure is flashed in several stages down from 210° F. to 100° F. By utilizing industrial waste heat as described by the instant application storing the heat at the low level in water and such flashing can be eliminated or at the very least reduced in extent thereby dramatically reducing the amount of compression needed to raise the temperature of the steam to usable levels. For example, when water is flashed in its final stages, from say 150° F. to 100° F. steam, electrical power is required to raise the pressure of the 100° F. and 125° F. steam. If 175° F. industrial waste heat is available say in the form of saturated 150° F. steam, the final flashing stages are unnecessary so the power used to raise the pressure of 100° F. and 125° F. steam is conserved. During discharge cycles the stored heat LVP material transfers its thermal energy to a carrier fluid which powers a turbine by means of expansion. Normally various cuts of turbine extraction steam are withdrawn from the turbine to reheat the stored water used as the source of low level heat in the charging cycle. By using industrial waste heat the amount of turbine extraction steam withdrawn can be greatly reduced if not totally eliminated (depending upon the temperature of the industrial heat available and whether any stored water system is used at all). For example, if waste heat at 175° F. is available which generates 150°

F. steam, then there is no need to withdraw turbine steam for water heating purposes at and below the 150° F. level, allowing the steam to fully expand in the turbine thereby producing additional power. Furthermore, said 150° F. waste heat steam can itself be used during peak load periods to generate power either by injection into its own low output turbine and generator or into an appropriate stage of the main turbine.

The industrial waste heat can be collected and utilized by means of a water loop through which process cooling water is circulated. The cooling water is heated in the various process coolers which are fitted into this circuit in accordance with their temperature level, i.e. cool water will first flow into those exchangers needing lower temperature coolant and will finally pass through those exchangers where the heat rejection is carried out at the highest temperature level. The hot cooling water is then flashed in one or several stages to produce steam for feed into the compressor or turbine of the energy storage system. The flash-cooled water may be further cooled by conventional means before being recycled for process cooling service.

This arrangement is particularly advantageous since it combines the gathering of waste heat from several dispersed sources and the generation of thermodynamic cycle heat pump vapor in a single integrated operation. Of course the waste heat collected by the circulating water can also be converted to low pressure heat pump feed vapor by heat exchange wherein the hot circulating water is used to heat and vaporize the desired thermodynamic fluid such as butane or freon, etc., which is then compressed to heat the oil during the off-peak hours.

By the practice of the instant improvement it is possible to operate a thermal energy storage system utilizing a heat pump wherein there is no stored water at all. Such a system exhibits tremendous efficiency advantages over a comparable system which uses stored water, since the heat (in the form of steam) is available at a higher temperature, (say as steam at 210° F. or more) requiring the expenditure of absolutely no electrical power to compress low temperature steam up to that level as was required in the case of stored hot water which had to be flashed at decreasing temperature levels to recover the stored heat. During use periods, since 210°-250° F. steam is available in the form of waste heat there is no need to withdraw any steam from the turbines to reheat cool water to heat it for storage purposes thereby permitting the complete expansion of the steam to generate power. Furthermore, the 210°-250° F. or higher (over 350° F. in some instances) waste heat can be used to power either auxiliary turbines or main turbines at appropriate stages to generate power.

Alternatively or simultaneously the stored high level heat can be used to provide high level industrial process heat.

Reference to Table I serves to demonstrate the improvement experienced by the practice of the instant invention.

TABLE I

| Waste Heat Available And Fed Into The Storage System as Saturated Steam at ° F | Energy Storage Efficiency % (Power Out/Power In) | |
|---|---|---|
| | Waste Heat Only | Waste Heat And Water Storage |
| None | — | 56.9 |
| 125° F | 76.7 | 61.2 |
| 150° F | 89.2 | 71.2 |
| 175° F | 105.5 | 91.5 |
| 200° F | 126.5 | 119.0 |
| 210° F | 136.5 | 136.5 |

The above are based on $10^6$ lb/hr of oil cycling between 520°-250° F. and water cycling between 100° F. and 210° F.

Table I shows the effect of waste heat available at different temperature levels on the apparent efficiency (power out vs power in) of the overall storage system.

The first column in Table I shows the temperature level at which the industrial waste heat is available and at which it can be fed into the heat pump/hot oil storage system, preferably, in the form of saturated vapor (e.g. steam) at that temperature. The second column shows the overall efficiency of the system (power out/power in) when this vapor is compressed during off-peak hours and the heat is stored in LVP material (oil) for use during peak demand periods to generate electricity, while at the same time also expanding said waste heat vapor during this peak demand period to generate additional electricity. The greater than 100% efficiency attained in these cases is due to the additional power which is produced (and not fed into storage as such) from the industrial waste heat. The third column of Table I shows the overall efficiency which is attained when the storage capability of the system, when tied to a given source of industrial waste heat is expanded by including a certain amount of hot water storage as well. However, the temperature range over which the hot water system is allowed to cycle between "full" and "empty" has 210° F. as the upper limit, and the waste heat temperature as the lower limit. When there is no waste heat available, i.e. the first row in Table I, the lower limit was set at 100° F. and the case is identical with the heat pump described in our copending Ser. No. 738,604. When the waste heat is available at 210° F., there is no temperature range for the water to swing over, i.e. no need for hot water storage, and the second and third column systems and efficiencies are identical.

Depending upon the final use to which the system is to be put and/or the engineering problems which must be considered in utilizing the system, if all the waste heat, especially the high temperature portion (that exceeding 350° F.) from a heat source is collected and used, tremendous quantities of power can be stored at efficiencies of greater than 100%. If efficiencies of 75% are acceptable, since this is the usual efficiency of conventional storage devices such as pumped water systems, the amount of power stored can be doubled by the inclusion of hot water storage.

By the practice of this invention the excess power generated during off-peak periods can be stored for recall during high power demand periods without the use of gas turbines, etc., which consume our limited and costly natural resources (and increase air and water pollution levels) or the necessity of designing and building overly large power stations merely to handle relatively short term high power demands. The process of the instant invention is independent of the type of electric power station involved, it being useful with nuclear, fossil fuel, solar geothermal, hydroelectric, tidal, hydrothermal, etc. Since it is the excess electric power which is being stored by conversion of heat into a more available form, i.e. at a higher temperature level, the energy storage, reconversion and utilization means disclosed in the instant invention can be sited close to the load demand area, i.e. close to a metropolitan area if a source of waste heat is available (i.e., institutional or industrial facilities), since the energy used to charge the heat storage means is excess electric power (traveling over conventional power lines). Ideally, the storage system will be cited close to a large, dependable source of waste heat such as an oil refinery, chemical plant, paper mill or steel mill with the stored electrical power going in and out over the conventional power lines of the grid. The storage and retrieval system does not have to be sited near the power plant. Pollution problems are avoided since no fuels are expended in practicing this invention. The power stations which produce the excess electrical power benefit tremendously from the instant invention since they can be run at optimum rate and maximum efficiency. In the case of nuclear power plants, the reactors need not be throttled (a difficult and inefficient use of such a plant). In the case of modern fossil fuel plants, there is also a technical need to operate them at steady output, and the pollution control devices can be designed and sized for maximum efficiency since the plant can be run at a steady state. Power stations which run in cyclic fashions due to fluctuating power sources (i.e. solar) can be designed for and operated at maximum output, with the excess output being stored so as to level the load enabling a cyclic or unavoidably variable output station to satisfy load demand which does not match the output characteristics of the station.

PRIOR ART

French Patent No. 2,098,833 issued Mar. 10, 1972 to Babcock-Atlantique discloses a heat accumulation system for balancing off-peak and peak demands in a thermal power producing unit. The heat accumulation system stores the high level heat made available at the power house by means of a compressor which acts as a heat pump on high pressure primary steam during off-peak periods. This enables the temperature of a heat transfer fluid to be raised to a temperature sufficient to superheat steam to a high pressure turbine during peak demand periods so that a power unit with a rated capacity below peak load can carry the load by utilizing this heat stored during off-peak periods. The process utilizes as a heat source, the primary high pressure steam drawn from the power cycle an expansion machine for the working fluid, means for circulating one or more fluids, a heat accumulator and an apparatus for compressing the fluid containing the heat to be stored before transferring the heat to the accumulator. The heat accumulator used in the system is a single vessel wherein the heat is stored by its transfer from a heat transfer fluid to corrugated plates. The heat is stored in the ceramic packing of the accumulator which of necessity results in a continuous degrading of the level of the heat on the accumulator. The important difference is that patentee is sited at the powerhouse and works with the primary power cycle. The instant invention is independent of location, cycle and retrofit size of unit. Flexibility is achieved while oil contamination and oil fouling of the main plant heat exchangers is avoided. Such a unit also is not subject to nuclear regulation since it in no way alters the design or operation of the basic nuclear facility. By way of comparison, the instant invention utilizes industrial and/or municipal waste heat as a primary source of heat for the charging cycle and a stored mobile heat retention material, that is, a heat retention material moving from a hot storage location to a cold storage location. Such movement of the LVP thermal energy heat retention material exhibits the distinct advantage over nonmoving heat retention systems (accumulators) in that by moving the LVP material the heat transfer fluid being heated and boiled is continuously being contacted with full high temperature LVP material for as long as there is material stored in the high temperature vessel. This means that for the entire period of peak power demand, or for as long as there is material stored in the hot storage vessel, the heat transfer fluid will contact uniformly hot material and will therefore be converted to high temperature vapor under constant conditions. By comparison, in a fixed bed thermal accumulator heat is stored by passage of a hot thermal energy carrier fluid through the bed. On flowing from one end to the other of said accumulator, the fluid will give up heat by thermal conduction to the solid tiles or ceramic particles making up the bed, resulting in a temperature front advancing along the bed in the direction of flow. Behind this front, the temperature of the solid will be close to the temperature of the entering hot fluid. Ahead of this front, the temperature of the solid and fluid will be essentially that of the packing when the operation started. The width of the front (length of bed over which the temperature changes from that of the hot fluid to that of the cold packing) is a function of many parameters including heat capacities and heat transfer properties, fluid flow rate, bed and particle diameter, etc. Also, the regularity or evenness of the front is very much a function of flow distribution, channeling, flow rates, etc.

The same holds true when the bed is hot and the entering fluid is cold, except all temperature indications are reversed.

The net effect of using a fixed bed accumulation at initial temperature $T_a$ on a fluid flowing through it with initial temperature $T_i$ is that the fluid will leave the accumulator at a temperature close to $T_a$ for a period of time set by the time required for the above temperature front to advance through the length of the accumulator. This time is strictly a function of the heat capacity of the flowing fluid vs. the heat capacity of the total accumulator packing.

When the front of the temperature front "breakthrough" reaches the end of the accumulator, the temperature of the fluid leaving the accumulator will slowly change from close to $T_a$ to close to $T_i$. The ratio of the length of time over which the effluent fluid is at a more or less constant temperature $T_a$ to the length of the varying temperature period is a measure of the efficiency of the solid accumulator method of storing heat. In real world situations due to slow heat transfer, poor liquid distributions and channeling and superimposed thermal convection currents, the ratio of constant/-varying effluent temperature periods is not sufficiently high to make this a preferred method of storing heat. Other disadvantages of storing heat in a solid accumulator system are expansion and contraction of the solid resulting in stresses and breakage, formation of fines which foul exchanger and the high cost of the accumulator and filtering devices. The specific heat of solids is usually much lower than that of liquids, resulting in a large weight and physical volume (allowing for voids) penalty and corresponding interstitially held up liquid in these large packed containers.

Another difference is that the invention of Babcock-Atlantique has its compression step work upon high pressure primary steam drawn from the boiler. This primary steam is sent to a compressor powered by direct coupling to the turbine. Of necessity this system must be located within the very confines of the power station. By comparison, the process of the instant invention is located away from the power station, close to the electricity consumers and utilizes principally waste heat as the charging cycle heat source, preferably in the form of low pressure steam, which nonprimary steam is then compressed in heat pump means, said heat pump being run by excess electrical power drawn from the power grid.

In the practice of this invention, the heat storage medium is described as a low vapor pressure organic heat retention material. Such an LVP material is a hydrocarbon oil preferably one derived from petroleum by distillation and refined, if necessary, by catalytic treatment for the hydrogenation of unsaturated and/or for the removal of sulfur and/or nitrogen in the presence of hydrogen under pressure utilizing any of the standard catalysts known in the art such as cobalt-molybdenum, nickel-molybdenum, etc. The hydrocarbon distillate can also be treated by means of solvent extraction to remove unstable, easily oxidized compounds which could lead to sludge and deposit formations on hot heat exchanger means surfaces. The LVP material can also be dewaxed by use of appropriate low-temperature crystallization/separation techniques known in the art to improve the low temperature handleability, (i.e. viscosity and fluidity) of the material. Before being treated as described above, the hydrocarbon distillate can be thermally and/or catalytically cracked to remove any thermally unstable material present but such cracking should be followed by hydrogenation to remove any unsaturates resulting from the cracking.

The hydrocarbon distillate used should be the fraction within the boiling range of 500° to 1300° F., preferably 600° to 1100° F. The vapor pressure of the material used for such thermal energy storage should not exceed 1 atmosphere at the maximum utilized storage temperature and should preferably be below 0.25 atm and most preferably below 0.1 atm. Such low vapor pressures are preferred since they facilitate the use of unpressurized storage means, transport means and heat exchanger means and such unpressurized systems are naturally more economical, desirable and more easily maintained. Such materials of low vapor pressure are kept in isolation from the environmental atmosphere so as to avoid material degradation, by means of an inert gas atmosphere blanketing the stored material or may be accomplished by use of an insulated floating roof or diaphragm type apparatus over the stored material, or by a combination of these two systems. It should be noted that the higher the vapor pressure, or even the closer the vapor pressure gets to 1 atm, problems arise in systems isolation and materials handling. Inert gas transfer and balance between hot and cold storage means is a potential problem when the organic material has a vapor pressure approaching or exceeding 1 atm at the hot storage temperature.

Typical materials which qualify as LVP organic heat retention materials are exemplified but cannot be viewed as exhaustively disclosed by the following.

Vacuum gas oil obtained from crude 650° F. VT atmosphere pipestill bottoms by running in a vacuum pipestill, getting a 650°/1050° F. VT cut followed by hydrodesulfurization over a catalyst in the presence of $H_2$ under pressure;

The vacuum gas oil described above further treated by solvent extraction to remove unsaturates, sulfur and nitrogen compounds and aromatics;

Catalytic cracking cycle stock with a boiling range of from about 600° to 950° F. drawn from a recycle catalytic cracker followed by hydrotreating. The feed to the catalytic cracker, which is usually a material with a boiling range of from 500° to 900° F. may but does not necessarily have to have been hydrotreated for sulfur removal prior to cracking;

Thermally cracked gas oil, e.g. steam cracked gas oil in the 600° to 1000° F. boiling range after appropriate catalytic hydrotreating to saturate olefins and diolefins and to decrease sulfur and nitrogen content;

Double extracted and dewaxed 600° to 1000° F. VT vacuum pipestill fraction, suitably hydrotreated (hydrofined);

600° to 900° F. VT fraction obtained from hydrocracking, a process in which heavy gas oils are catalytically broken down and hydrogenated over a catalyst in one or more steps;

600° to 900° F. VT coker gas oil suitably stabilized by catalytic hydrogenation.

The sulfur levels in the feeds considered may range, prior to hydrogen treatment, from 0.3 to 5.0% and should be of the order of 0.05 to 1.0% following treatment.

Oxidation stability additives and sludge dispersants and depressants may be added to the material to improve its performance in the hot LVP thermal energy retention material (i.e. oil) storage locations. Typical antioxidants are hindered phenols, such as t-butyl phenol and typical dispersants may be sulfonates or ashless dispersant based adducts. The content of the antioxidants and dispersants in the LVP material will preferably be below 1% each.

FIG. 1 is a schematic of the instant invention. During off-peak periods a vapor containing the municipal or industrial waste heat is taken from the source 1 through conduits 2 to a compressor 3 being driven by a motor 4 powered by the excess electrical power from the power station or power grid. The compressed vapor is moved through conduits 5 to heat exchangers 6 wherein a LVP heat retention material moving from a cold LVP storage location 7 through conduits 8 to a hot LVP storage medium 9 is heated. During charging vent valves X are closed as is valve Y in conduit 10. Spent hot compressed vapor in conduit 5 is permitted to vent through 5A.

During discharging or during peak power demand periods the hot LVP from 9 flows through conduit 8 through heat exchanger 6 to vessel 7. In the heat exchangers the hot LVP heat retention material heats up a fluid or vapor flowing in conduit 5. The hot fluid or vapor in 5 is introduced to the turbine 3 where it expands and is used to drive a generator 4. Waste heat vapor from 1 also may be permitted to flow into the turbine 3 through conduits 2 and help drive the generator. Spent hot fluids and vapors in 3 are vented through Z since valves X are open.

Alternatively or simultaneously, during discharge or peak demand period valve Y may be open permitting the hot LVP material to flow through conduit 10 for use in industrial uses, Q, such as space heating, water heating, etc. The cold LVP material from Q is stored in vessel 7.

What is claimed is:

1. In a process for storing the off-peak electrical output of an electricity generating plant in the form of heat in a low vapor pressure (LVP) organic heat retention material and recalling said heat from said LVP organic heat retention material during period of peak power demand by reconversion into electrical power or utilization as high quality process heat comprising the steps of:

(a) using excess electrical power to run a compressor;
(b) compressing a low level heat containing vapor to raise the temperature of said heat containing vapor;
(c) contacting said high temperature heat containing vapor through heat exchanger means with an LVP material;
(d) storing said hot LVP material in isolation from the atmosphere at atmospheric pressure;
(e) during periods of peak power demand using said stored hot LVP material as fluid heat transfer medium in industrial applications;

the improvement comprising using as the low level heat containing vapor in step (b) the waste heat containing vapor generated by industrial and/or municipal installations.

2. The improved process of claim 1 wherein the industrial application of step (e) is the generation of additional electricity.

3. The improved process of claim 1 wherein the industrial application of step (e) is an industrial process heat utilization means.

4. The improved process of claim 1 wherein the industrial application of step (e) comprises both industrial process heat utilization and additional electricity generation.

5. The improved process of claim 2 wherein additional electric power is generated during peak demand periods by the utilization of additional steam generated by means of the low level industrial waste heat available during said period.

6. The improved process of claim 1 wherein the industrial and/or municipal waste heat used as the source of low level heat is collected by means of a water loop wherein the water is heated so as to produce steam which is compressed by means of said compressor using excess electrical power whereby said steam is raised to a high temperature for contacting with the LVP material for storage.

7. The improved process of claim 6 wherein the hot water is used to heat a thermodynamic fluid which is compressed to a high temperature and used to heat a LVP material for storage.

8. The process of claim 6 wherein the hot water, produced in said water loop by contact with the waste heat source is used to heat a thermodynamic fluid which thermodynamic fluid is used to generate additional electric power.

* * * * *